US005206967A

United States Patent [19]

Fushiya et al.

[11] Patent Number: 5,206,967

[45] Date of Patent: May 4, 1993

[54] ELECTRIC WAX APPLICATOR

[75] Inventors: Fusao Fushiya, Nagoya; Hideki Ohkubo, Nishio, both of Japan

[73] Assignee: Makita Electric Works, Ltd., Anjo, Japan

[21] Appl. No.: 893,607

[22] Filed: Jun. 3, 1992

Related U.S. Application Data

[63] Continuation of Ser. No. 579,803, Sep. 7, 1990, abandoned.

[30] Foreign Application Priority Data

Dec. 27, 1989 [JP] Japan ..... 1-151235

[51] Int. Cl.[5] ..... B24B 29/00

[52] U.S. Cl. ..... 15/97.1; 51/170 MT

[58] Field of Search ..... 15/22.1, 22.2, 22.4, 15/97.1, 98, 52.2, 230.17; 51/170 MT, 170 TL

[56] References Cited

U.S. PATENT DOCUMENTS

| | | | |
|---|---|---|---|
| 2,904,805 | 9/1959 | Dardig | 15/97.1 |
| 3,251,087 | 5/1966 | Platt, Jr. | 15/98 |
| 3,302,232 | 2/1967 | Wasiloff et al. | 15/230.17 |
| 3,345,784 | 10/1967 | Stelljes et al. | 51/170 |
| 3,416,177 | 12/1968 | Young | 15/98 |
| 3,445,877 | 5/1969 | Stout | 15/22.1 |
| 3,655,444 | 4/1972 | Young | 15/98 |
| 4,095,375 | 6/1978 | Klebe | 51/170 MT |
| 4,188,682 | 2/1980 | Burglin et al. | 15/97 R |
| 4,476,602 | 10/1984 | Hurn et al. | 15/28 |
| 4,625,462 | 12/1986 | Fushiya | 51/170 MT |
| 4,729,194 | 3/1988 | Maier et al. | 51/170 MT |
| 4,791,694 | 12/1988 | Itaya et al. | 15/97.1 |
| 4,907,313 | 3/1990 | Roeker et al. | 15/230.17 |
| 5,003,659 | 4/1991 | Paepke | 15/230.17 |

FOREIGN PATENT DOCUMENTS 50-10649 4/1975 Japan .

*Primary Examiner*—Edward L. Roberts
*Attorney, Agent, or Firm*—Lahive & Cockfield

[57] ABSTRACT

An electric wax applicator comprises a housing, a pad defining a bottom portion of the housing, a sponge removably joined to a lower surface of the pad, an electric motor provided in the housing and having a drive shaft, a crank member connected to the drive shaft and including a balancer portion and an eccentric shaft portion which has a center deviated slightly from an axis of rotation of the drive shaft and is rotatably received in a bearing of the pad, and a pad support of resilient material located between an inner horizontal partition wall of the housing and the pad. The pad support may include first supporting members joined both to the pad and to the partition wall of the housing and second supporting members joined only to either of the pad and the partition wall of the housing. When the wax applicator is switched on, the crank member rotates together with the drive shaft. While the crank member is rotating, the eccentric shaft portion thereof vibrates to cause the pad to vibrate in the plane in which the pad is located.

6 Claims, 3 Drawing Sheets

ELECTRIC WAX APPLICATOR

This is a continuation of copending application Ser. No. 07/579,803 filed on Sep. 7, 1990 now abandoned.

FIELD OF THE INVENTION

This invention relates to an electric wax applicator, especially for use with a motorcar.

BACKGROUND OF THE INVENTION

It is easier to apply wax uniformly to a surface with an electric wax applicator than by hand. With the conventional electric wax applicator, however, since the pad is rotated, the wax applied to the sponge may be scattered by the centrifugal force of the pad. A mechanism for reducing the speed of the motor may be used to prevent the wax from scattering. However, if such a mechanism is used, the size or weight of the applicator becomes large. Needless to say, the larger the size or weight of the applicator is, the less easy it is to handle the applicator. Also, since the pad is rotated, the applicator may move of itself along the surface to which the applicator is applied. In addition, for the same reason, a portion of the wax applied may produce an arc on the surface and, hence, the wax may not be uniformly applied to the surface.

SUMMARY OF THE INVENTION

It is an object of the invention to provide an electric wax applicator, especially for use with a motorcar, which is free from the foregoing drawbacks of the conventional electric wax applicator.

Another object of the invention is to provide an electric wax applicator with a pad which is not rotated, but is vibrated in a plane in which the pad is located.

According to the invention, an electric wax applicator is provided which comprises a housing, a pad defining a bottom portion of the housing, a sponge removably joined to a lower surface of the pad, an electric motor provided in the housing and having a drive shaft, a crank member connected to the drive shaft and including a balancer portion and an eccentric shaft portion which has a center deviated slightly from an axis of rotation of the drive shaft and is rotatably received in a bearing of the pad, and pad supporting means of resilient material located between an inner horizontal partition wall of the housing and the pad. The pad supporting means may include first supporting members joined both to the pad and to the partition wall of the housing and second supporting members joined only to either of the pad and the partition wall of the housing.

DETAILED DESCRIPTION OF A PREFERRED EMBODIMENT

Figure 1:
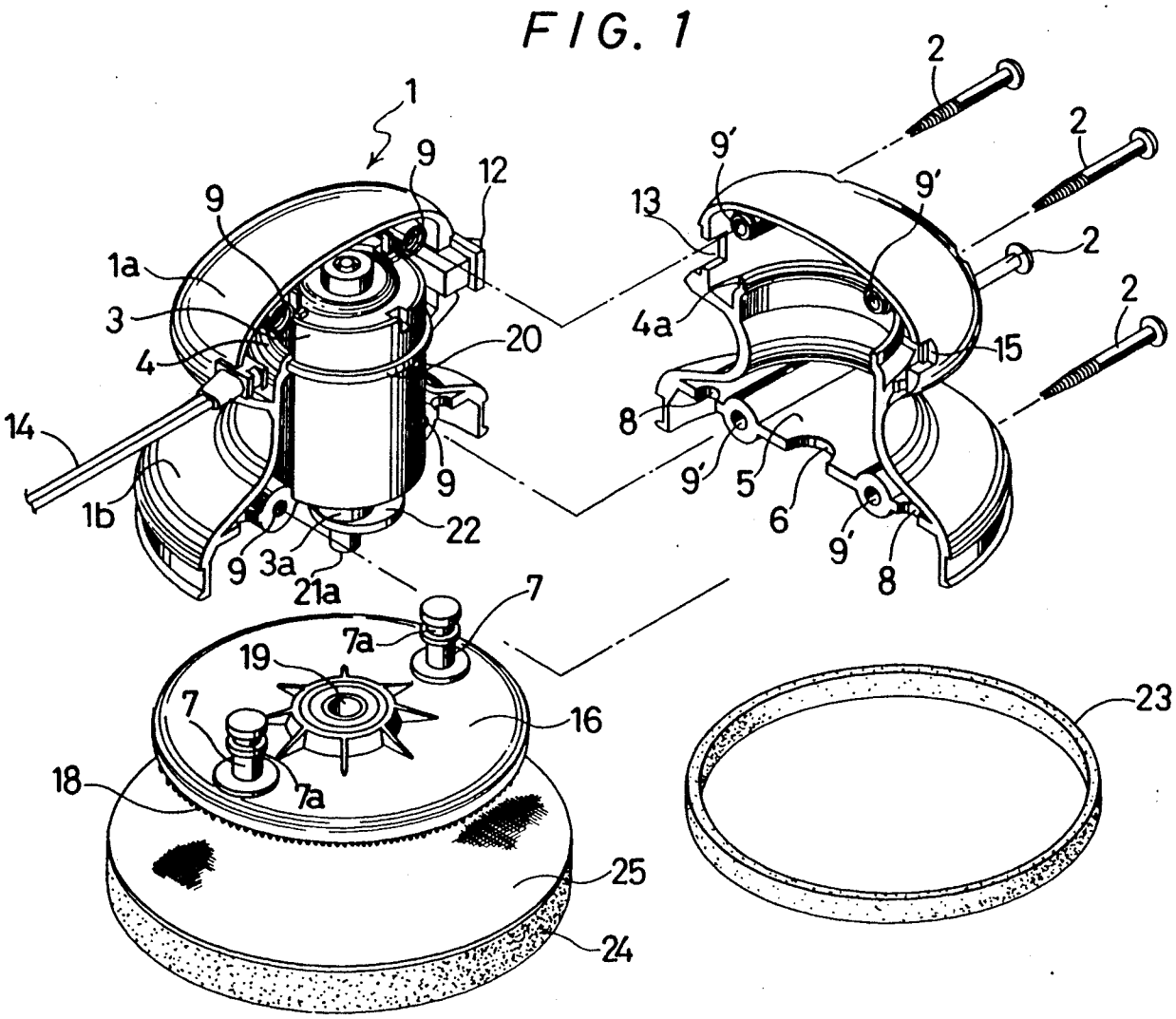
FIG. 1 is an exploded view of an electric wax applicator of the invention.

An electric wax applicator which embodies the invention in one preferred form will now be described with reference to the drawing.

Referring to FIG. 1, the electric wax applicator includes a housing 1 with an upper, oval portion 1*a* and a lower, circular portion 1*b*. As shown in FIG. 1, the housing 1 can be separated into half shells. The half shells are united in a body by inserting set screws 2 through guide openings 9' (provided in one half shell) into threaded openings 9 (provided in the other half shell). The threads of the set screws 2 engage with the threads of the openings 9. When using the wax applicator, one may hold the oval portion 1*a* of the housing 1.

Figure 2:
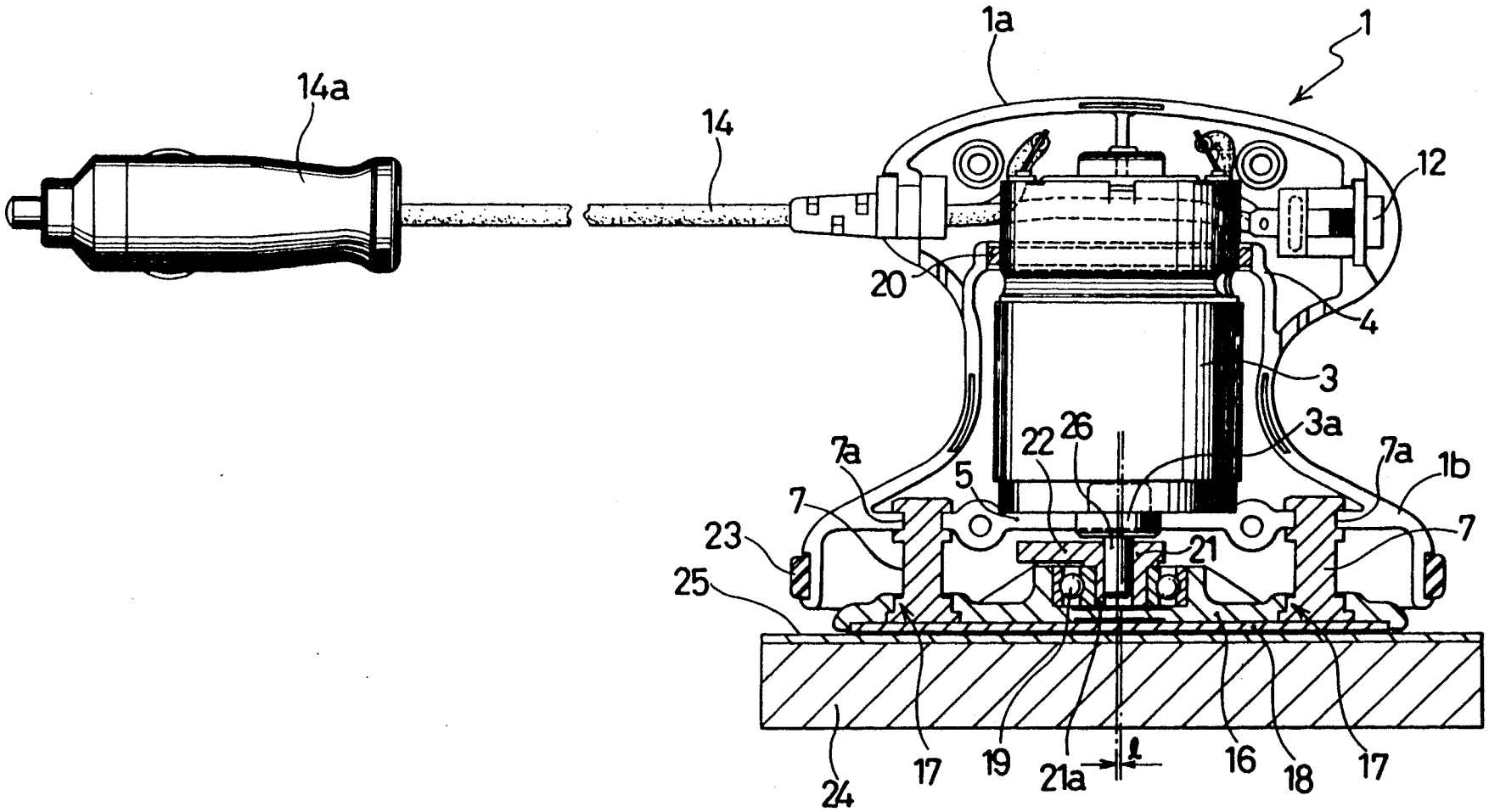
FIG. 2 is a vertical cross section of the applicator of FIG. 1.
Figure 3:
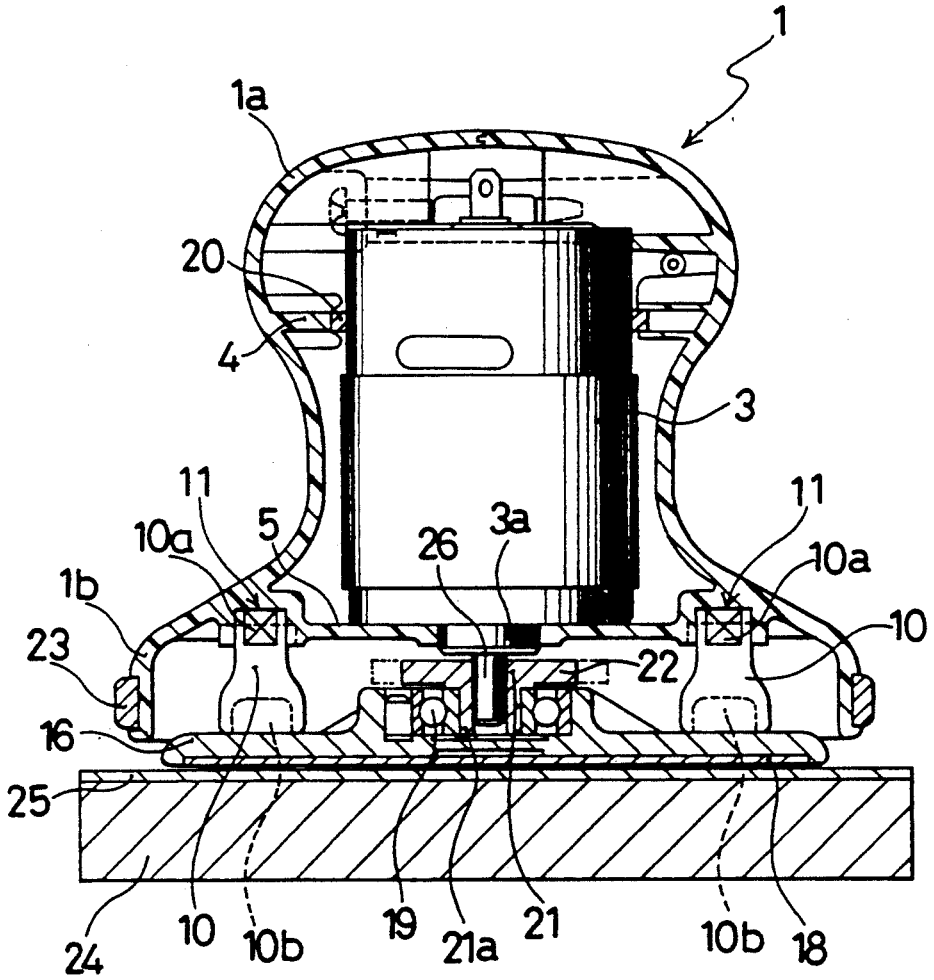
FIG. 3 is a vertical cross section of the applicator of FIG. 1 which is perpendicular to the cross section of FIG. 2.

An electric motor 3 is provided in the housing 1. A rubber ring 20 is fit on a circumference of the motor 3. The rubber ring 20 is received in a groove 4*a* of a flange portion 4 of the housing 1. The housing 1 has an inner, horizontal partition wall 5. The partition wall 5 has a central opening 6. A bearing portion 3*a* of the motor 3 is located in the central opening 6 (FIGS. 2 and 3). Also, a pair of openings 8 are made through the partition wall 5. The openings 8 are located with the central opening 6 between. Recessed portions 7*a* of first pad supporting members 7 fixed to a pad 16 are received in the respective openings 8 (FIG. 2). Each of the openings 8 and 6 is separated into two equal halves when the housing 1 is separated into the half shells.

The lower guide openings 9 and the lower threaded openings 9' are formed in the partition wall 5.

The partition wall 5 is also provided with a pair of bottom holes 11. The bottom holes 11 are so located that an imaginary straight line connecting the bottom holes 11 intersect an imaginary straight line connecting the openings 8. Each bottom hole 11 is defined by opposed parallel sides and opposed curved end portions. Upper ends 10*a* of second pad supporting members 10 are received in the respective bottom holes 11 (FIG. 3) for seating the support member 10. The upper end 10*a* of each second supporting member 10 has a shape similar to the shape of the bottom hole 11. Each second supporting member 10 has a lower end 10*b* which is greater than the upper end 10*a*. The lower end 10*b* has an inner recess indicated by a broken line of FIG. 3.

The housing 1 has an opening 13 in which a motor switch 12 is located. The housing 1 also has an opening 15 through which a power cord 14 passes. The power cord 14 is electrically connected both to the motor 3 and to the motor switch 12. A plug 14*a* is connected to an outer end of the power cord 14. In use the plug 14*a* is inserted into the cigarette lighter of a car.

The motor 3 has a drive shaft 26. A crank member 21 is connected to the drive shaft 26 (FIGS. 2 and 3). The crank member 21 consists of a balancer portion 22 and an eccentric shaft portion 21*a*. The balancer portion 22 and the eccentric shaft portion 21*a* are formed integrally with each other.

The shaft portion 21*a* has a center deviated from the axis of rotation of the drive shaft 26 by the distance 1 which may be 0.5 millimeter, for example (FIG. 2).

The shaft portion 21*a* is received in a bearing 19 of a pad 16. The pad 16 has a pair of recesses 17. Each recess 17 includes a lower, larger-diameter portion and an upper, smaller-diameter portion (FIG. 2). The lower end portions of the first pad supporting members 7 have shapes corresponding to the shapes of the recesses 17, and are held in the respective recesses 17. Thus, there is no possibility that the first pad supporting members 7 may be removed from the pad 16. The bottom of the pad 16 is provided with a VELCRO material 18.

As described above, the recessed portion 7*a* of the first pad supporting member 7 is received in the opening 8 of the partition wall 5. The first pad supporting member 7 thus holds the pad 16 to the partition wall 5. However, the first pad supporting member 7 holds the pad 16 thereto not fixedly, but such that the pad 16 can vibrate in a horizontal plane, or in the plane in which the pad 16 is located. The first pad supporting member 7 may be made of rubber. As described above, the upper end 10*a* of the second pad supporting member 10 is received in the bottom hole 11 of the partition wall 5. The lower end 10*b* of the second pad supporting member 10 is in contact with the upper surface of the pad 16 (FIG. 3). The upper end 10*a* of the second pad supporting member 10 has a shape defined by opposed parallel sides and opposed curved end portions. The bottom hole 11 of the partition wall 5 has a similar shape. Therefore, there is no possibility that the second pad supporting member 10 may be removed from the partition wall 5 when the pad 16 vibrates. Further, the second pad supporting members 10 resist movement of the pad 16 relative to the housing 1 along a direction parallel to the motor shaft 26.

The second pad supporting member 10 also may be made of rubber.

It will be appreciated that, since the recessed portion 7*a* of the first pad supporting member 7 is held in the opening 8 of the partition wall 5, the pad 16 cannot be rotated.

A rubber bumper 23 is fit on a lower portion of the housing 1.

Reference numeral 24 designates a sponge. The upper surface of the sponge 24 is provided with a VELCRO material 25. The VELCRO material 25 is joined to the VELCRO material 18 provided on the bottom of the pad 16. Thus it will be appreciated that the VELCRO materials 25 and 18 comprise a VELCRO system. Thus, the sponge 24 is removably joined to the pad 16.

In use the plug 14*a* of the power cord 14 is inserted into the cigarette lighter of a car. Wax is applied to the lower surface of the sponge 24. The oval portion 1*a* of the housing 1 is held by hand. The sponge 24 is applied to the car surface to be polished. Then, the applicator is switched on. Thereupon, the drive shaft 26 rotates. The crank member 21 also rotates together with the drive shaft 26. While the crank member 21 is rotating, the eccentric shaft portion 21*a* thereof vibrates in horizontal directions (in FIGS. 2 and 3). To be more exact, while the crank member 21 is rotating, every point on the eccentric shaft portion 21*a* describes a circle with the eccentric distance 1 as a radius. Thus, the pad 16 vibrates (in the plane in which the pad 16 is located) together with the eccentric shaft portion 21*a* with every point on the pad 16 describing the same circle as every point on the eccentric shaft portion 21*a*. The sponge 24 vibrates together with the pad 16.

The wax on the sponge 24 is thus uniformly applied to the car surface. It is not necessary for the user to be very careful not to press the sponge 24 heavily against the car surface. If the sponge 24 is pressed heavily against it, the heavy pressure is absorbed both by the frictional force between the sponge and the car surface and by the elasticity of the sponge 24. Therefore, if the pressure exerted by the user is varied, the pressure exerted to the car surface by the sponge may be kept constant.

What is claimed is:

1. In an electric wax applicator having (a) a housing, (b) a pad received in a bottom portion of the housing, (c) a sponge removably and replaceably joined to a lower surface of the pad, (d) an electric motor mounted in the housing and having a drive shaft, (e) a crank member connected to the drive shaft and including a balancer portion and an eccentric shaft portion having a center deviated slightly from the axis of rotation of the drive shaft and rotatably received in a bearing of the pad, the improvement comprising pad supporting means of resilient material secured between the housing and the pad, said pad supporting means including A. first resilient supporting members joined both to the pad and to the housing for mountingly securing the pad to the housing, said first members being so joined by seating in apertures in the pad and in the housing, and B. second resilient supporting members joined, by seating in apertures, to only one of the pad and the housing and in contact with the other, said second members being spaced from said first members and resisting movement of said pad relative to said housing along a direction parallel to said drive shaft.

2. In an electric wax applicator according to claim 1, the further improvement wherein said first resilient supporting members mountingly secure said pad to said housing for allowing said pad to vibrationally move relative to said housing and said first resilient supporting members are aligned with one another along a first imaginary line that extends through the axis of the motor drive shaft, and said second resilient pad supporting members are aligned along a second imaginary line that passes through the axis of said motor shaft and that intersects said first imaginary line.

3. In an electric wax applicator according to claim 1, the further improvement wherein each first supporting member has opposed ends for respectively mountingly engaging said housing and said pad, and each of said housing and said pad has aperture means for removably and replaceably mountingly receiving one respective end of each first pad supporting means.

4. In a hand-held electric wax applicator having (a) a housing having a pad-receiving bottom portion, (b) a pad received in said housing, (c) an electric motor provided in the housing and having a drive shaft and a bearing portion, (d) a crank member connected to the drive shaft and having a shaft portion rotatably received in a bearing of the pad, and (e) the shaft portion having a center deviated slightly from the axis of rotation of the drive shaft, so that when the crank member is rotated by the drive shaft, every point on the shaft portion describes a circle with a radius corresponding to the amount of deviation of the center of the shaft portion from the axis of rotation of the drive shaft, thereby causing the pad to vibrate relative to the housing in a direction perpendicular to the axis of rotation of the drive shaft, the improvement comprising A. means forming first openings in said housing, B. means forming second openings in said pad, and C. first pad supporting members fixed to said pad by seating in said second openings and being seated in said first openings, said first members being thereby coupled between said pad and said housing for mounting said pad in said housing, said first pad supporting members being resilient and allowing said pad to vibrate in a direction perpendicular to the axis of rotation of the drive shaft and preventing said pad from rotating relative to said housing, said first pad supporting means providing the sole mounting of said pad to said housing.

5. In a hand-held electric wax applicator having (a) a housing having a pad-receiving bottom portion, (b) a pad received in said housing, (c) an electric motor provided in the housing and having a drive shaft and a bearing portion, (d) crank member connected to the drive shaft and having a shaft portion rotatably received in a bearing of said pad, and (e) the shaft portion having a center deviated slightly from the axis of rotation of the drive shaft, so that when the crank member is rotated by the drive shaft, every point on the shaft portion describes a circle with a radius corresponding to the amount of deviation of the center of the shaft portion from the axis of rotation of the drive shaft, thereby causing the pad to vibrate relative to the housing in a direction perpendicular to the axis of rotation of the drive shaft, the improvement comprising A. means forming second openings in said pad, B. first and second shells constituting said housing when coupled together, (i) each said shell having and inner recessed base portion with a middle semicircular cut and two side semicircular cuts aligned on either side of said middle semicircular cut along an imaginary line that extends through the axis of said middle semicircular cut, (ii) the middle semicircular cuts of said shells defining a central opening in said base portion of said housing, and said side semicircular cuts of said shells defining first openings in said base portion of said housing, (iii) said bearing portion of said motor being concentric with said central opening, and C. first pad supporting members, (i) each said first pad supporting members having a recessed portion removably and replacedly seated in one of said side openings for seating that first member in said first openings, (ii) said first pad supporting member being fixed to said pad by being seated in said second openings, (iii) said first pad supporting members being coupled between said pad and said housing for mounting said pad to said housing, and being resilient and allowing said pad to vibrate in a direction perpendicular to the axis of rotation of the drive shaft and preventing said pad from rotating relative to said housing, and (iv) said first pad supporting members providing the sole mounting of said pad to said housing.

6. In an electric wax applicator according to claim 5, the further improvement comprising second resilient pad supporting members joined only to either of said base portion and the pad, and abutting the other of said pad and said partition wall.

* * * * *